US009248366B2

(12) United States Patent
Walker

(10) Patent No.: US 9,248,366 B2
(45) Date of Patent: Feb. 2, 2016

(54) BOARD SPORT BINDING

(71) Applicant: Bon Hiver

(72) Inventor: Brendan Walker, New York, NY (US)

( * ) Notice: Subject to any disclaimer, the term of this patent is extended or adjusted under 35 U.S.C. 154(b) by 0 days.

(21) Appl. No.: 14/631,067

(22) Filed: Feb. 25, 2015

(65) Prior Publication Data

US 2015/0238844 A1 Aug. 27, 2015

Related U.S. Application Data

(60) Provisional application No. 61/944,316, filed on Feb. 25, 2014.

(51) Int. Cl.
*A63C 10/14* (2012.01)
*B63B 35/81* (2006.01)

(52) U.S. Cl.
CPC ..... *A63C 10/14* (2013.01); *B63B 35/812* (2013.01)

(58) Field of Classification Search
CPC ..... A63C 10/02; A63C 10/14; A63C 10/16; A63C 10/18; A63C 10/28; A63C 10/285; A63C 5/03
USPC ..... 280/14.21, 14.22, 14.24, 612, 613, 617, 280/618, 626, 629
See application file for complete search history.

(56) References Cited

U.S. PATENT DOCUMENTS

| | | | | |
|---|---|---|---|---|
| 3,667,771 | A * | 6/1972 | Larson | A63C 9/0802 280/612 |
| 5,906,388 | A * | 5/1999 | Neiley | A43B 5/0401 280/14.22 |
| 7,270,337 | B1 * | 9/2007 | Carotenuto | A63C 10/14 280/14.24 |
| 7,823,300 | B2 * | 11/2010 | Fullerton | A43B 1/0054 280/612 |
| 7,837,218 | B2 * | 11/2010 | Flaig | A63C 9/0802 280/14.22 |
| 2003/0094788 | A1 * | 5/2003 | Jacobs | A63C 10/02 280/612 |

* cited by examiner

*Primary Examiner* — John Walters
(74) *Attorney, Agent, or Firm* — John D. Lanza; Foley & Lardner LLP

(57) ABSTRACT

An apparatus for a board binding system. A board can include a channel that includes the a first magnet. A plurality of caps can be affixed to the board, separated by a distance capable of holding a binding assembly. An adjusting plate can be affixed to the binding assembly. The adjusting plate can secure the binding assembly to the board via engagement with the plurality of caps. The binding assembly can include a second magnet. The binding assembly can be configured to dock or undock with the plurality of caps by arranging the second magnet above the first magnet and rotating the binding assembly.

20 Claims, 10 Drawing Sheets

BOARD SPORT BINDING

RELATED APPLICATIONS

This application claim priority to and the benefit of U.S. Provisional Application No. 61/944,316 filed on Feb. 25, 2014, entitled "Board Sport Binding Mechanism."

BACKGROUND

When riding a snowboard, kiteboard, or wakeboard, each of the user's boots is secured to the board surface with an apparatus called a "binding." The bindings keep the user and board from separating during the ride down the slope or across the water. Bindings are also commonly configured to transfer forces from the user to the board, allowing the user to control the board during the ride.

For snowboarding, one common type of binding for use with a snowboard may be referred to as a "strap-in" binding that may be designed to receive a boot, such as, for example, a "soft boot." A strap-in binding commonly incorporates one or more adjustable straps that when tightened push the user's boot against the relatively rigid interior surfaces of the binding. The pressure of the straps and the interior surfaces hold the boot in the binding while the snowboard is in use and help the user to control the snowboard.

Another common type of snowboard binding may be referred to a "step-in" binding. A step-in binding may incorporate a relatively flat base that includes a mechanism that connects to hinges, fixtures, or other mechanisms on the bottom of the user's boot. A boot for use with a step-in binding is typically more rigid and sturdy than one typically used with a strap-in binding, and the rigid structures of the boot may transmit forces exerted by the user to the board, helping the user to control it. The construction that makes a boot for use with a step-in binding may also make the boot heavier than a soft boot, however, as may the hardware built into the boot that is needed to secure the boot to the snowboard.

Inconveniences attend the use of either of the strap-in binding and the step-in binding. For example, securing a boot inside a strap-in binding commonly requires that the user's hands be available to tighten the straps. A common problem is that a snowboard user cannot ride directly off of a ski lift and onto a slope, as skiers may do, because the user typically must first get off of the ski lift and then secure the remaining unattached boot to the appropriate binding. Also, when snowboarders ride the lift with one boot in the binding and one boot out of the binding, the entire weight of the snowboard causes a strain on the single foot and boot strapped into the binding.

Step-in bindings, as mentioned above, commonly entail using boots that may be heavier and stiffer than the soft boots that may typically be used with a strap-in binding. The weight and rigidity may make such boots less comfortable to wear than soft boots, and even experienced snowboard users may feel that the weight and rigidity compromise the user's control of the snowboard during a ride.

For wakeboarding and kiteboarding, two common types of bindings for use with the board may be referred to as an "open-toe" or "closed-toe" bindings. Both of these bindings may be designed to receive a foot without a boot as the binding itself incorporates the supportive structure around the user's foot and ankle to act as the boot as well as the interface to connect to the board and enable the user to control the board. Effectively, this boot/binding combination remains permanently fixed to the boards surface during normal use via threaded screws and threaded inserts in the board. Another common type of binding, primarily used for kiteboarding, may be referred to as a "strap" that may be designed to receive the foot without any supportive boot structure. The strap commonly incorporates a base underneath the foot and a strap stemming from that base that wraps laterally, from the arch of the foot, around the top of the foot with the heel and toes exposed.

Inconveniences attend the use of the open-toe and closed-toe binding. Due to the binding being affixed to the board for use via threaded screws and inserts, it is difficult to customize the fit of the binding for each individual user. Also, to secure feet into the bindings, each user must take a considerable amount of time to insert his or her feet into the binding to secure them tightly. This is done sometimes on land or on the boat, but also in the water. This inconvenience adds considerable amount of time when interchanging riders on the wakeboard.

Straps also have several shortcomings when used for kiteboarding. As the user must manage a kite and keep it in the air, the user's hands are usually required for such an operation, thus making securing of the foot into the straps very difficult. This requirement is one of the reasons why kiteboarders use straps as opposed to open-toe or closed-toe bindings that require the use of hands to adjust and secure them for usage. Also, when a kiteboarder is executing maneuvers such as flips and spins, straps fail to provide the proper support to keep the board securely on the user's feet and thereby can cause the board to fall off or become difficult to manage.

BRIEF SUMMARY

A board binding can comprise three main cooperating parts or assemblies. A first part, referred to as a "binding assembly," may be secured to a user's soft boot. A second part, referred to as the "caps," may comprise two components that house locking components that may be secured permanently to the board. A third part, referred to as the "magnets," may comprise a single magnet or plurality of magnets that are embedded in the board's surface or on top of the board. The binding assembly and the caps may be detached from one another and may also be securely reattached to each other with aid of the magnets so that the user can ride the board. By means of example, the binding assembly may house magnets that, when they come in close proximity to magnets housed in the board, may unite the binding assembly, board, and caps via magnetic attraction and align the binding assembly with components in the caps that could enable the user to engage a mechanical lock.

The binding assembly, caps, and the magnets may be configured to help a user to join the binding assembly and caps without use of the hands. For example, the user may wear a soft boot secured in a binding assembly and may by moving the leg or foot align the binding assembly with the caps via the force of the magnets, allowing the components to be docked together. The user may then by rotating the foot cause the components to engage with each other to prevent the components from separating.

Continuing to rotate the foot may cause a locking mechanism to engage, keeping the components joined in a configuration for use. The locking mechanism may keep the components in this configuration until manually disengaged.

A board binding can comprise a binding assembly configured to accept a boot while the boot is being worn by a user and comprising one or more adjustable straps located to secure the boot in the binding assembly. The binding assembly is capable of being secured to a board while the boot being worn by the user is secured in the binding assembly. The binding assembly may be capable of being separated from the board while the boot being worn by the user is secured in the binding assembly.

A board binding apparatus can comprise a binding assembly that may be configured to accept a boot while the boot is being worn by a user and comprises one or more adjustable straps located to secure the boot in the binding assembly. The board binding apparatus can also comprise caps that are permanently affixed to a board deck and capable of being locked to the binding assembly and released from the binding assembly.

The binding assembly and the caps may be configured to be docked with one another prior to being locked together. The binding assembly can comprise one or more magnets. The board can comprise one or more magnets, The magnets in the binding assembly and the magnets in the board may be configured to attract the binding assembly and the caps to each other in a docked configuration. Further, when the caps and the binding assembly are in a docked configuration, rotating the binding assembly around an axis perpendicular to the board deck may mechanically engage the binding assembly and the caps. Further rotating the binding assembly around the axis may engage a locking mechanism in the caps that prevents reversing the rotation, thereby securing the binding assembly and the caps in an engaged and aligned position for use.

The caps can comprise one or more shelves. The binding assembly can comprise one or more protrusions referred to as "nubs." The shelves and the nubs may be located in relation to one another so as not to interfere with docking the binding assembly to the caps, but also so that rotating the binding assembly around an axis perpendicular to the board deck causes the shelves to overlap the nubs in a configuration that prevents separation of the binding assembly from the caps and the surface of the board. The nubs may move along a vertical axis until a point at which they are located relatively along the same plan as the shelves. At that point, the binding assembly may be rotated horizontally, rotating and positioning the nubs underneath the caps, at which point, the nubs will be prevented from further vertical movement as they have slid underneath the caps.

Further rotating the binding assembly around the axis may engage a locking mechanism that prevents reversing the rotation, thereby securing the binding assembly and the caps in an engaged and aligned position for use.

DETAILED DESCRIPTION

Figure 1:
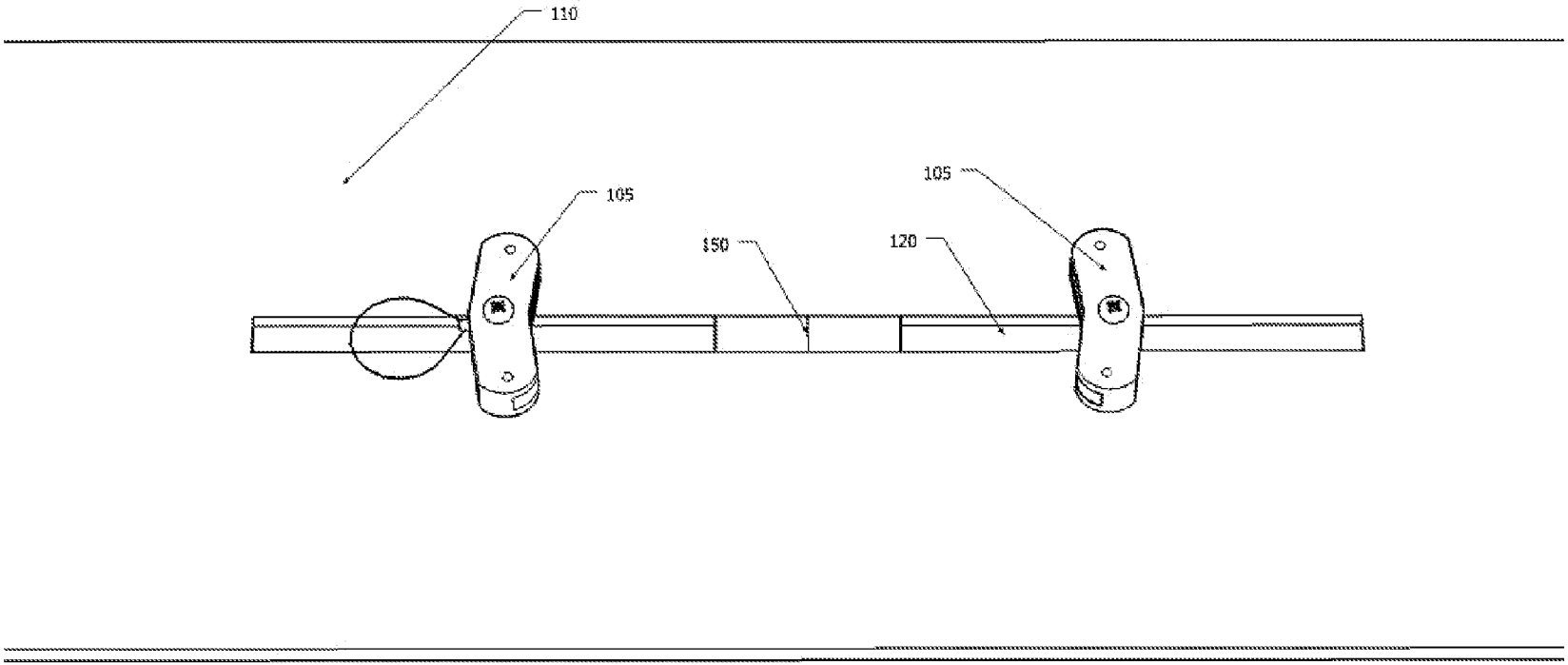
FIG. 1 depicts the caps affixed to a board deck and a channel in the board housing a series of magnets.

FIG. 1 depicts the caps 105 affixed to a board 110. As depicted, the cooperating component may comprise magnets 150 inside a channel 120 in the board 110. The caps 105 are depicted without the binding assembly 125.

A user may use a snowboard, for example, by riding the snowboard down a slope while the user is secured to the snowboard. A user may use a wakeboard or kiteboard, for example, by riding across the water being pulled by a marine vehicle, motorized cable, or kite while the user is secured to the wakeboard or kiteboard.

Figure 2:
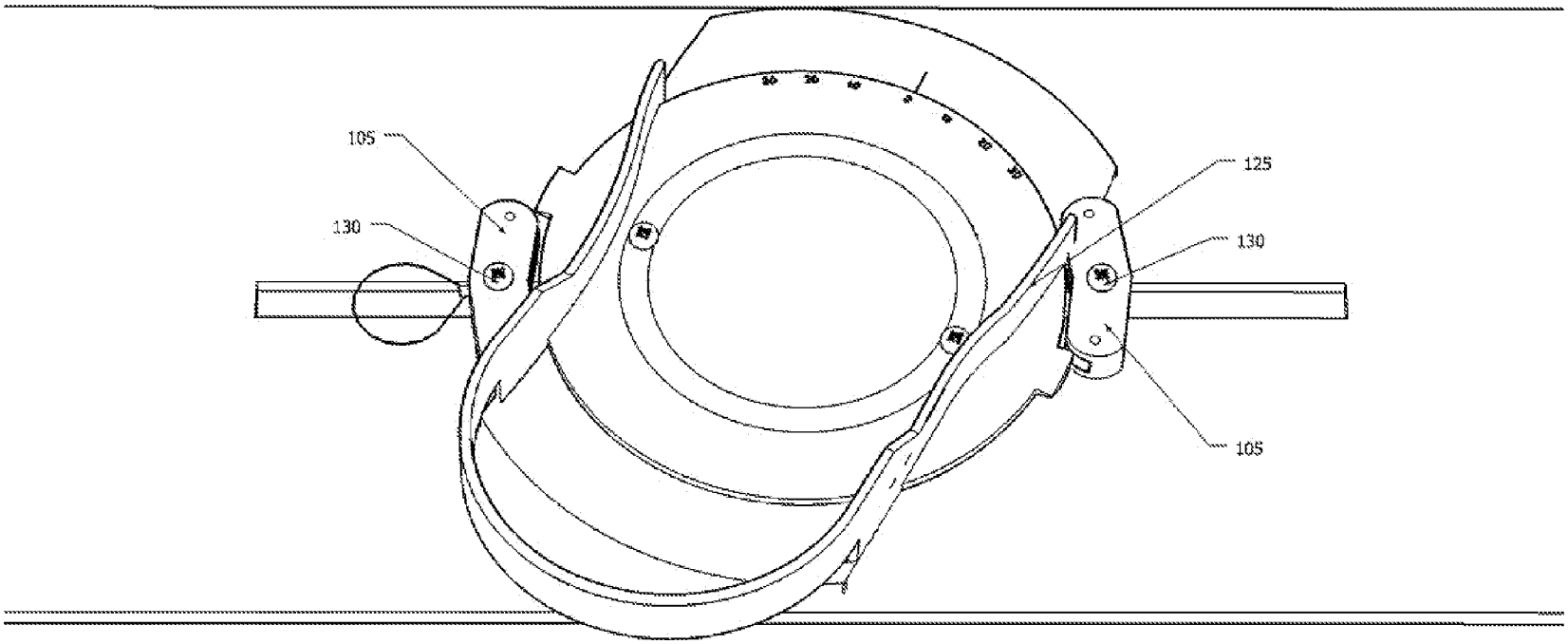
FIG. 2 depicts a portion of the binding assembly, viewed from above, docked with the caps via the alignment of the magnets in the binding assembly with the magnets in the channel in the board.
Figure 3:
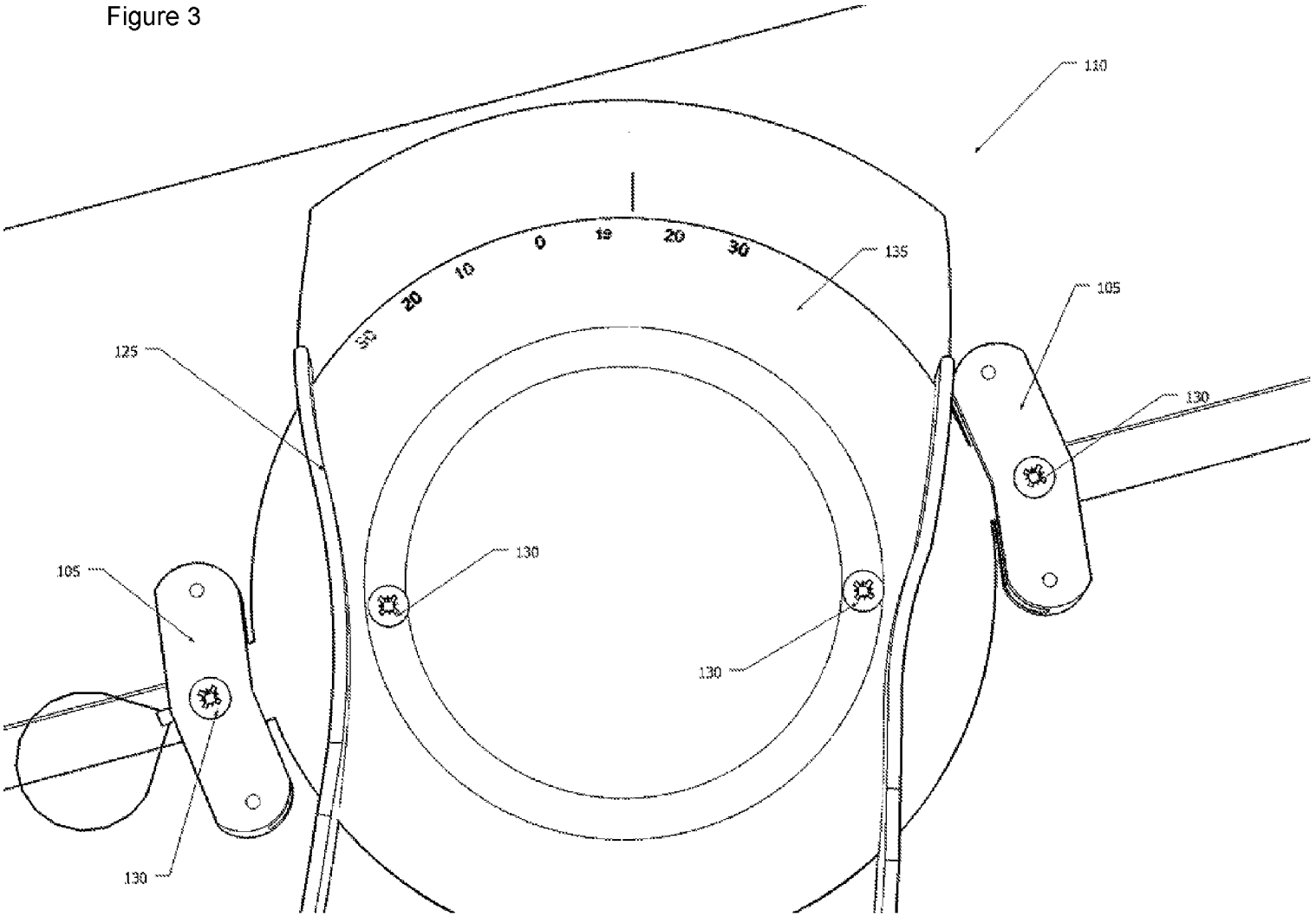
FIG. 3 depicts a portion of the binding assembly, viewed from above, mechanically locked with the caps on top of the board deck after the user counters the force of the magnets and rotates the binding assembly in an axis perpendicular to the surface of the board.

FIG. 2 depicts the caps 105 that may be permanently held to the top of a board 110. For example, the feature or configuration held permanently may or may not be alterable without causing damage to the assembly 100 or any one or more parts of it, and, if alterable, making such alteration may or may not involve appropriate tools.

Methods of securing the caps 105 to the board 110 can include, for example, a board 110 with threaded metal inserts (not pictured) incorporated. Caps 105 may be fastened, e.g., directly to the board 110 by one or more fasteners 130 such as threaded bolts, screws, or studs, that pass through one or more holes in the caps 105 into the threaded inserts in the board.

As depicted in FIG. 2, FIG. 3, FIG. 4, FIG. 5, FIG. 6, and FIG. 7, the binding assembly 125 may not be directly affixed to the board 110, but may be held firmly against the board 110 and prevented from rotating by an adjusting or pivoting plate 135. The adjusting plate 135 may be affixed to the binding assembly 125 by threaded fasteners 130 that pass through respective holes in the adjusting plate 135. The adjusting plate 135 may be connected to the binding assembly 125 and adjusted as part of the binding assembly 125 to provide the user with a particular stance angle when using the board 110 such as in FIG. 7, where the adjusting plate 135 is set to approximately 15 degrees. The angle of the adjusting plate being 15 degrees is for illustrative purposes, as the angle may be 0 to 30 degrees. In addition, the adjusting plate 135 can be of any shape that can assist in the alignment of the magnet 150 in the board 110 to the magnets 140 in the binding assembly 100. For example, instead of a disc as depicted, the adjusting plate 135 can have a spherical, circular, triangular, rectangular, triskelion, bowtie-like, horseshoe (U), chi (X), torus (O), or any polygonal shape.

Returning to FIGS. 6 and 7, tightening the fasteners 130 (not shown) may cause the adjusting plate 135 to stay in a fixed position inside the binding assembly 125, thereby aligning the nubs 115 at a particular alignment outside of the binding assembly 125. The alignment of the binding assembly 125 relative to the board 110 may be set, e.g., when the binding assembly 125 is secured to the board deck 110 via the caps 105. The pressure exerted by the adjusting plate may hold the binding assembly 125 firmly and securely to the caps 105 on top of the board 110, and may inhibit rotation of the binding assembly 125 relative to the caps 105 and board 110. The alignment of the binding assembly 125 relative to the board deck 110 may be adjusted by loosening the fasteners 130, rotating the binding assembly 125 into a desired alignment, and then tightening the fasteners 130.

Figure 7:
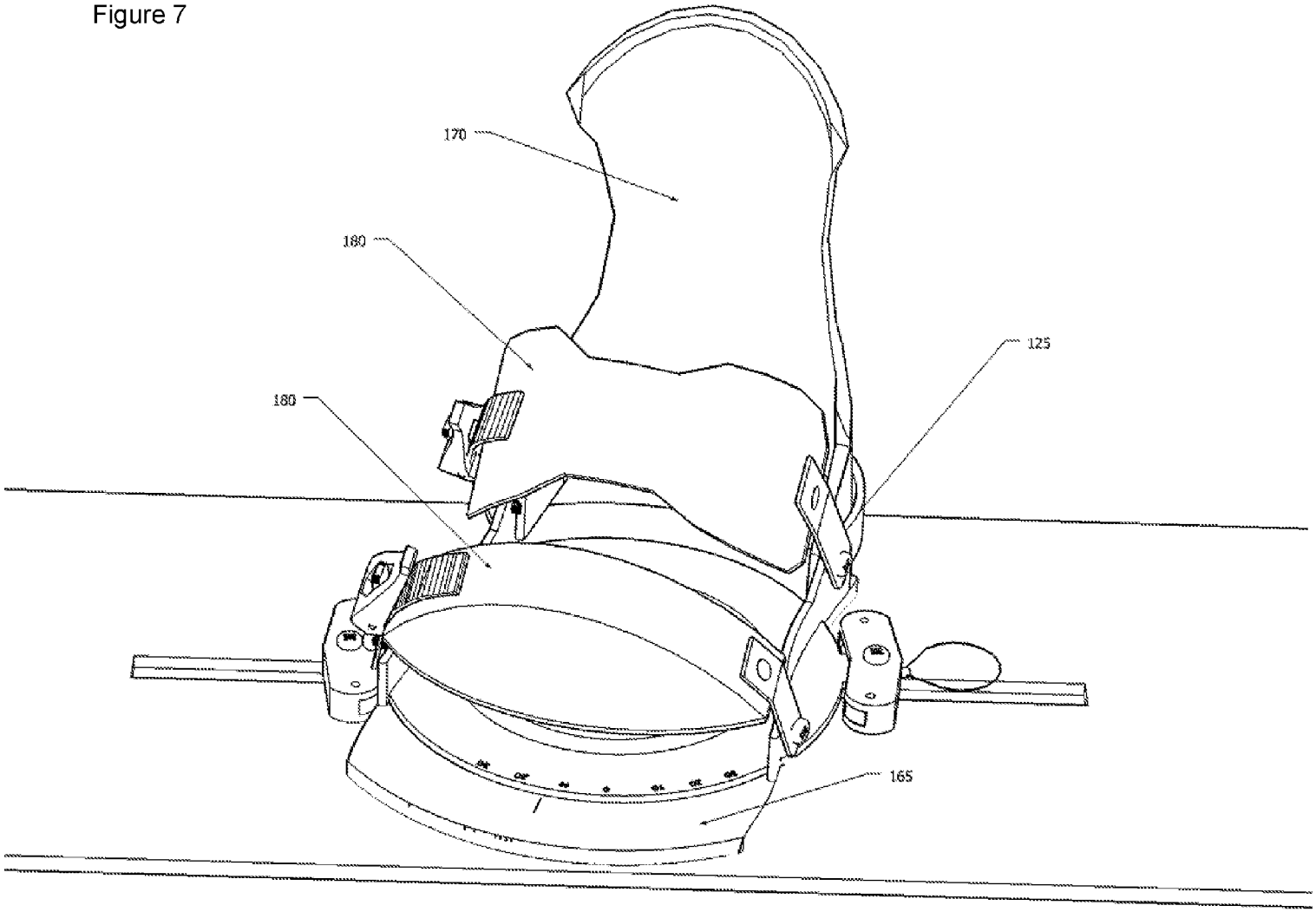
FIG. 7 depicts the binding assembly with straps and highback positioned on board for normal usage.
Figure 10:
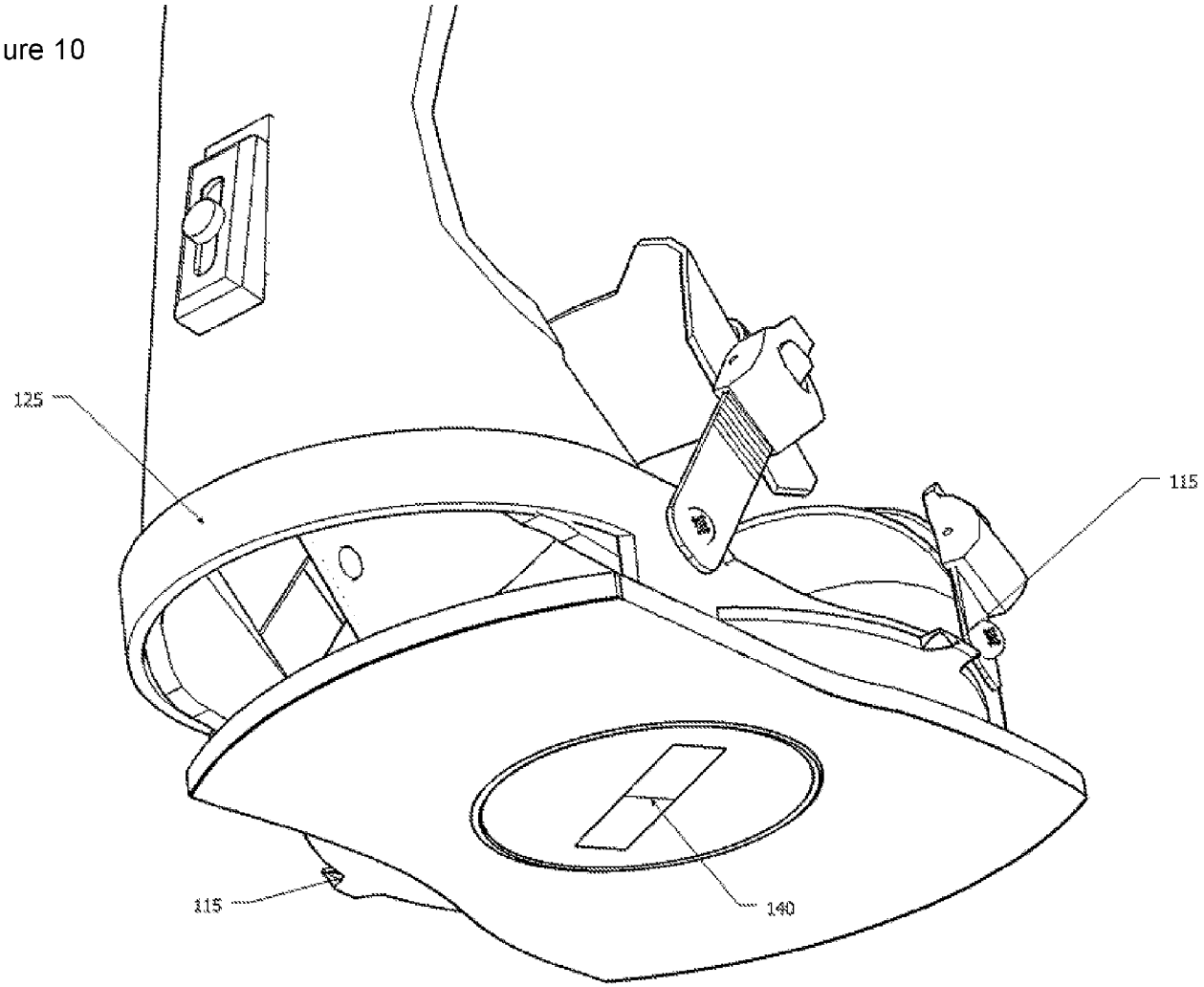
FIG. 10 shows the bottom view of the binding assembly 125 with the magnets 140 in the adjusting plate 135 visible that attract to the magnets 150 in the channel and the nubs 115 that interact with the shelves 160 in the caps 105 to keep the binding assembly 125 from moving during usage.

The dimensions of the binding assembly 125 and the adjusting plate 135 may be such that, e.g., when the fasteners 130 are fully tightened, the bottom of the adjusting plate 135 may be flush with the bottom of the binding assembly 125. In FIG. 10, the adjusting plate 135 is tightened to the binding assembly 125 such that the bottom of the adjusting plate 135 housing the magnets 140 are flush with the bottom of the binding assembly 125. This may enable the magnets 140 in the binding to come in contact with the magnets 150 in the channel in order to allow for optimal magnetic attraction between the components. This may, in line, position the nubs 115 on the adjusting plate 135 on a horizontal plane so that the user may rotate the binding assembly 125 about a vertical axis. Further, the nubs 115 may engage the cams 175 and force their rotation in order for the nubs to enter the cap assembly. The adjusting plate 135 may house magnets 140 that may be flush or nearly flush to the bottom of the adjusting plate 135. These magnets 140 may attract and be attracted to magnets 150 in the channel 120 of the board 110 as depicted in FIG. 1 and FIG. 7.

The board 110 may comprise one or more permanent magnets 145. For example, the binding assembly 125 may comprise cutouts 155, each with a flanged rim that is sufficient in extent and strength to retain one of the magnets 145 in the respective cutout 155 despite attraction between the magnet and any outside objects. The strength of such flanged rim should be sufficient enough to prevent the magnets 150 from being pulled out of the channel 120 by its own magnetic force or the combined force of such magnets 145 with another ferrous object. One or more of the magnets 145 may be, e.g., partially covered by or encased in, a material such as nickel or plastic to protect or improve the durability of the magnet 145. The one or more magnets may be encased inside the binding assembly 125 itself.

One or more of the magnets 140 may be glued to the surface of the board 110 or otherwise fixed inside the body of the board 110 via a channel 150. One or more of the permanent magnets 140 (not pictured) may be embedded in the actual material of the board 110 itself, making the top sheet of the board 110 ferrous. One or more of the magnets 140 may be fixed to the board 110 in a manner capable of exerting attractive or repulsive forces on an object above but relatively near to the board 110. For example, depending on the strength of the magnets, the magnets 140 may exert attractive or repulsive forces on an object such as the binding assembly 125 within a foot of the board 110.

Other ways may exist to incorporate one or more magnets in the board 110. For example, no portion of either magnet 140, 145 may protrude from the surface of the board 110 or binding assembly 125.

The caps 105 may comprise two separate sets of shelves 150, which project parallel to the board 110. Each shelf 150 may describe, e.g., a portion of an hypothetical circle (e.g., the arc of a circle) such that all shelves 150 describe respective portions of the same hypothetical circle.

One set of shelves 150 (the "left lateral shelves" 155) may be, e.g., on the edge of the board 110 nearest the left side of the user's foot. The left lateral shelves 155 may comprise, e.g., two shelves. In this example, the left lateral shelves 155 may be, e.g., ¼ of an inch from the surface of the board 110. The same or similar dimensions may be used, e.g., for the two depicted right lateral shelves 160.

The width of the shelves 150 may vary depending, e.g., on the strength and flexibility of the material or materials used and the manner of construction; the shelves 150 are ¼ inch wide. All shelves 150 may be the same thickness and width, but one or more of the shelves 150 may differ in thickness, width, or both from one or more other shelves 150.

Some or all of the shelves 150 may be made, for example, as integral parts of the board 110 or as distinct parts, that may be affixed directly or indirectly to the board 110 during manufacturing.

In FIG. 7, a board binding may comprise a binding assembly 125. The binding assembly 125 is configured to receive and retain a boot (not pictured), which may be worn by the user while the board is in use. For example, a binding assembly 125 may be configured, e.g., in a manner similar to that of a strap-in binding, such as described above, to receive a soft boot (not depicted) and to secure it in place with one or more adjustable straps 180 that are capable of holding the boot against the base 165 of the binding assembly 125 and a highback 170.

As described in more detail below, the binding assembly 125 may be configured to dock with the caps 105, e.g., guided or otherwise assisted by magnetic forces. Once docked, structures of the binding assembly 125, the nubs 115, may be engaged with structures of the caps 120, the cams 175, to hold the components together. While engaged, the components may be secured to one another in a configuration for use. A locking mechanism, comprising nubs 115 and cams 175, may hold the bases in an engaged and secured configuration until manually released.

As depicted in FIG. 7, the base 165 of the binding assembly 125 may contain one or more permanent magnets 140. One or more of the magnets 140 may be affixed to or embedded in the base 165 or the adjusting plate 145. For example, one or more of the magnets 145 may be affixed to or embedded in the board 110. One or more of the magnets 140, 145 may be, e.g., partially covered by or encased in a material such as nickel or plastic to protect or to improve the durability of the magnet 140, 145. Further, no part of the magnets 140, 145 protrudes from the lower surface of the binding assembly 125 of the board 110.

As depicted in FIG. 7, the relative polarities of the magnets 140, 145 as installed, may be such that the magnets 140, 145 attract one another. For example, when the upright binding assembly 125 is placed vertically above the board 110, aligned as depicted in FIG. 7. The respective polarities may also be chosen such that the respective pairs of magnets 140, 145 are mutually repelled. For example, if the binding assembly 125 is rotated 180 degrees relative to the board 110 from the alignment that FIG. 7 depicts.

The corresponding magnets 140 in the board 110 and the magnets 145 in the binding assembly 125 may be substantially equal in size. For example, the dimensions of the magnet 140 in the board can be 2 inches by 1 inch by 0.125 inch and the dimensions of the magnet 145 in the binding assembly may be 2 inches by 1 inch by 0.25 inch, varying in depth by 0.125 inch. These dimensions are for illustrative purposes, as the width, height, or depth of the magnets may vary by 0 inch to 6 inches. Furthermore, there may be a differing number of magnets in the binding assembly 125 and the board 110. For example, these dimensions may be comprised of a single magnet that is 4 inches by 1 inch by 0.25 inch or multiple magnets, such as 16 magnets that are 0.25 inch by 1 inch by 0.25 inch. In addition, the shapes of the magnets may vary. These shapes can include, for example, rectangular bars, disc, spheres, cubes, horseshoes, cylinders, rings, or other polygon shapes. Magnets 140 and 145 may also be permanent magnets, temporary magnets, electromagnets, or any other ferrous material. The corresponding magnets 140, 145 may be vertically aligned relative to each other when the binding assembly 125 and the board 110 are placed relative to one another, e.g., at an angle such as FIG. 7 depicts.

As depicted in FIGS. 2-7, with magnets configured magnetic attraction may hold the board 110 to the binding assembly 125 in an alignment. The magnets 140, 145 may be chosen to be sufficiently strong such that the depicted alignment may be maintained, e.g., against gravity or incidental forces, until the user chooses to exert sufficient force to disturb that alignment. Magnets may comprise, e.g., neodymium or other rare-earth magnets, but any sufficiently strong and compact magnets may be used.

One or more magnets may be replaced, e.g., with a piece of ferromagnetic material (not pictured). Each piece of ferromagnetic material in one component may correspond, e.g., to a magnet in the other component, e.g., such that magnetic attraction will pull the components together into a docked configuration.

The binding assembly 105 may comprise nubs 115, e.g., corresponding to the shelf features 150 of the caps 105. The nubs 140 may circumscribe portions of an imaginary circle in a manner similar to that in which the shelves 150 of the caps 105 describe portions of an imaginary circle. The imaginary circle that the nubs 115 circumscribe may have a slightly smaller diameter than that described by the shelves 150, which may, e.g., be consistent with the functions of the nubs 115 and shelves described below.

The placement and dimensions of the nubs 115 may be such that, for some relative placements of the caps 105 and the binding assembly 125, the nubs 115 and shelves 150 may be in an underlapping/overlapping configuration. For example, in a configuration or alignment in which one or more of the nubs 115 may be located wholly or partially underneath one or more of the shelves 150, e.g., as a result of rotation of the binding assembly 125 relative to the board 110, the shelf 150 may, e.g., prevent the binding assembly 125 from being simply pulled apart from the board 110. The orientation of the binding assembly 125 relative to the board 110 may be changed, e.g., by rotation of the binding assembly 125 in the clockwise or counterclockwise direction, before the components may be separated.

Figure 8:
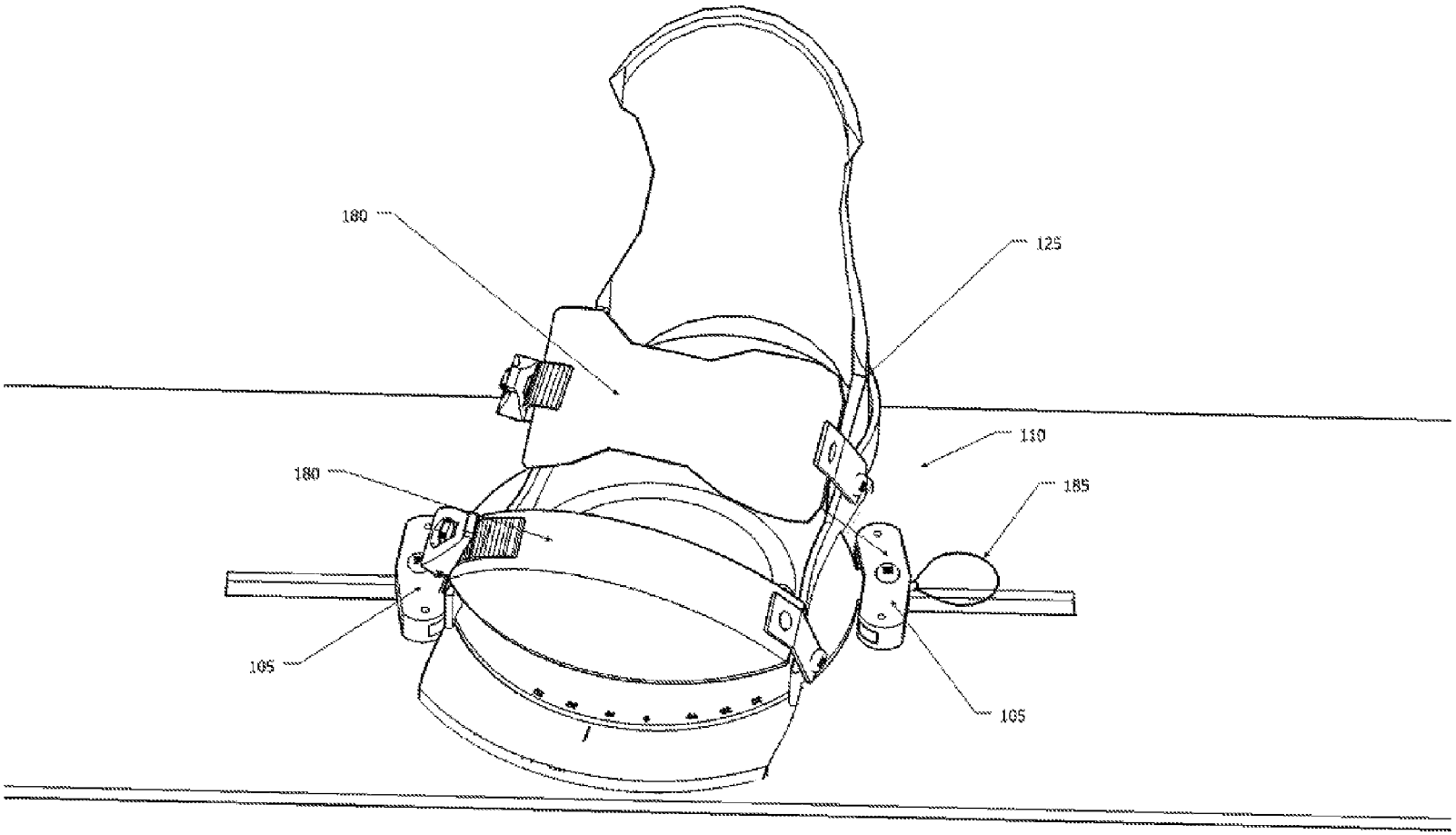
FIG. 8 is a view facing the binding assembly incorporating caps with a tethered leash used to disengage the locking mechanism in order to remove the binding assembly from the caps and board.
Figure 9:
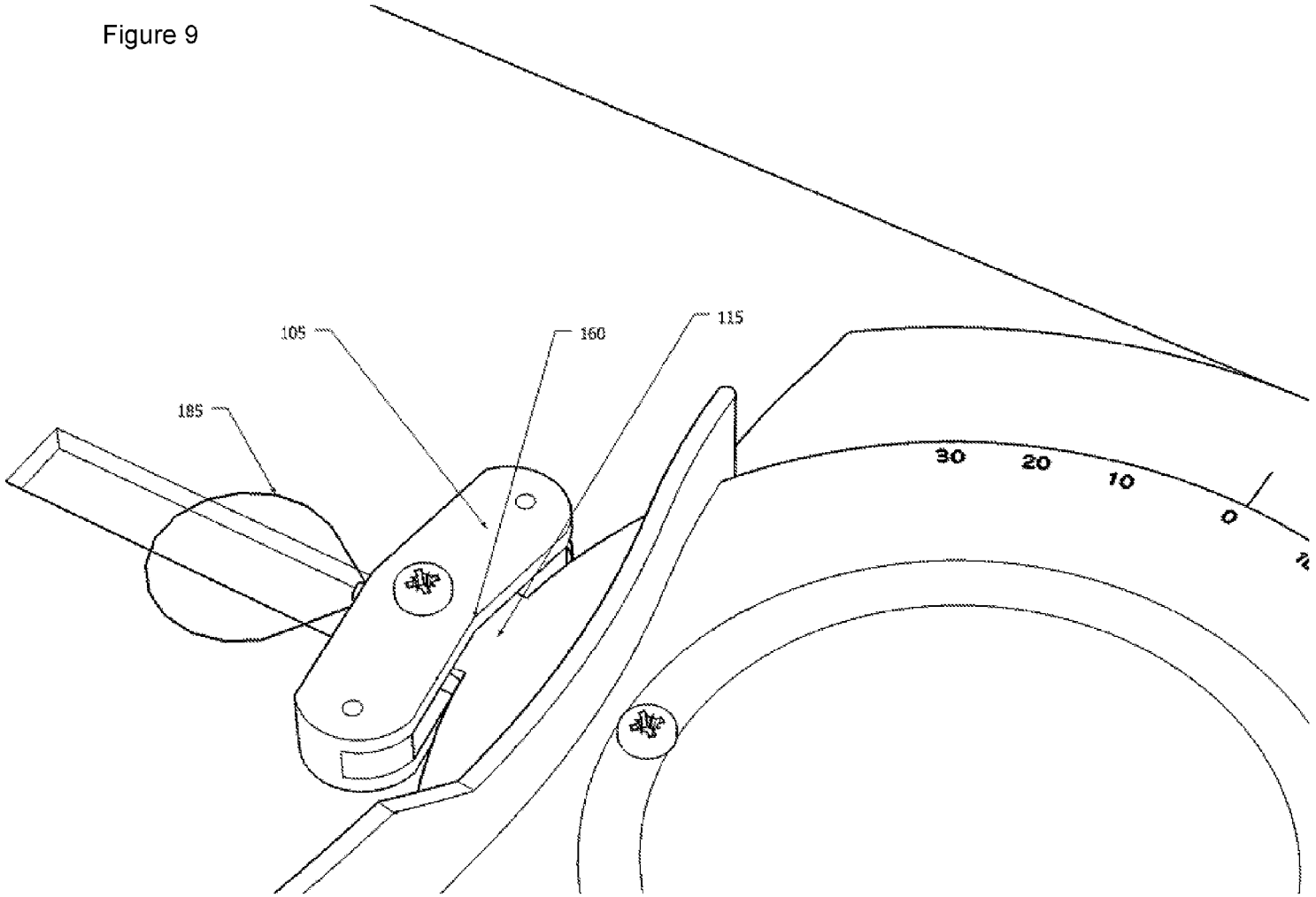
FIG. 9 is a view facing the binding assembly and caps showing the retention of the binding assembly in a position for normal usage.

In FIG. 8, the binding assembly 125 is connected to the board 110 for normal usage. FIG. 9 shows the positioning of the nub underneath the shelves 160 in the cap 105 after the user has rotated the binding assembly 125 about the vertical axis and mechanically locked the binding assembly 125 and the leash 185 that can be used to disengage the locking mechanism. To release the binding assembly 125 from the board 110, the user can simply pull the leash 185 that is connected to the cams 175 via a metallic wire to rotate them about the vertical axis. The rotation may enable the user to further rotate the bindings assembly 125 about the vertical axis to free the nubs 115 of any vertical obstruction by the caps 175. Other unlocking mechanisms can be used besides the leash. For example, a mechanical lever that can be pushed down, hook that can be pulled, arm that can be pushed down, O-ring that can be pulled, wedge that can be pulled, screw that can be loosened, or any other mechanical component can be used to disengage the binding assembly. In addition, the unlocking mechanism can be connected to the cams 175 used other material besides a metallic wire, such as plastic, textile fiber, synthetic, or composite materials.

For example, the shelves 150 on the caps 105 may have the dimensions described above The nubs 115 of the binding assembly may be approximately ¼ of an inch thick and flush with the bottom of the binding assembly and flush with the underside of the shelves 150. The relative sizes and alignments of the shelves 150 and nubs 115 may be such that the nubs 115 may slide relatively unimpeded below the shelves 150, e.g., as the binding assembly 125 is rotated relative to the board 110, until a point of maximum rotation is achieved.

As the binding assembly 125 is rotated relative to the board 110 towards a configuration in which the components are secured together for use, the relative tightness of the joining of the components may increase, e.g., to prevent or reduce any wobbling or other unsteadiness in the joint. One or more of the shelves 150 or nubs 115 may taper (not pictured) to increase this firmness as the relative rotation increases. The required rotational force may increase as the degree of rotation increases, but the required force may not require subjectively excessive exertion by the user Returning to FIG. 4, as depicted, the caps 105 and a binding assembly 125 are in what may be referred to as a docked configuration. In such a configuration, the corresponding meeting surfaces of the components may sufficiently flush against one another to present no substantial impediments to rotating the components relative to each other while maintaining substantial contact between the surfaces. As depicted, in this configuration, no overlap may exist between any of the nubs 115 and any of the shelf features 150 such as might interfere with the contact between the meeting surfaces of the components.

Figure 4:
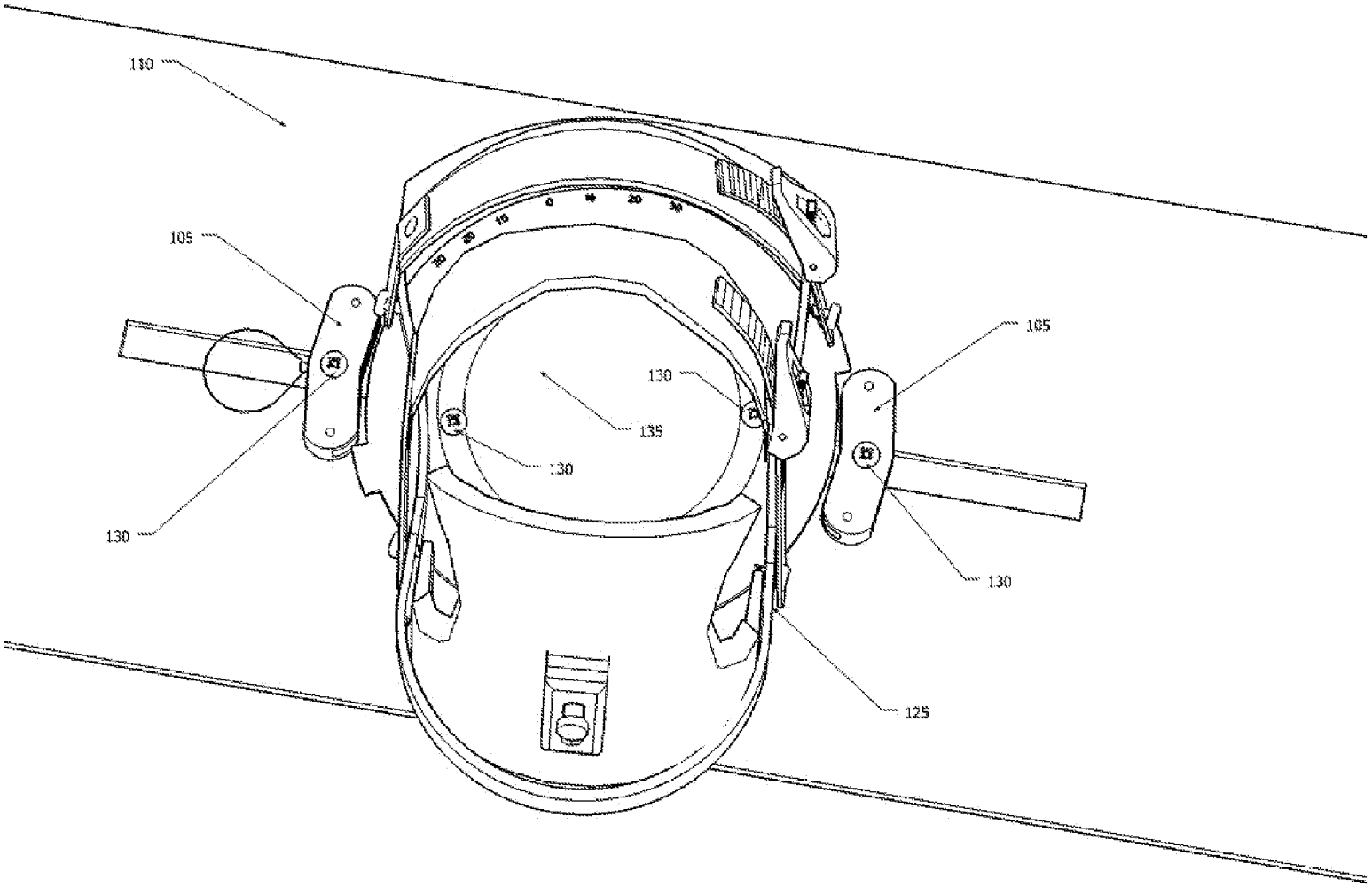
FIG. 4 depicts the binding assembly, viewed from above, docked with the caps via the alignment of the magnets in the binding assembly with the magnets in the channel in the board.

As depicted in the figures, the magnets may tend to hold the components in a docked alignment such as FIG. 4 depicts. Geometry or one or more corresponding structures on one or both components may serve to guide the components into a docked configuration or to retain them in such a configuration, in addition to or instead of magnets as described above. Rotation may be used to engage structures that retain the components in a joined configuration, any such structures may be designed not to interfere with such rotation. For example, a circular indentation (not pictured) in the underside of the binding assembly 125 may correspond to a circular raised portion (not pictured) on the upper side of the caps 105.

The corresponding nubs 115 and shelves 150 may engage to retain the binding after minimal counterclockwise or clockwise rotation. Maximal counterclockwise or clockwise rotation may be achieved when the lateral edges of the components are evenly aligned with one another. For example, beginning from the docked configuration, the binding assembly 125 may rotate counterclockwise or clockwise through an angle of 20 degrees, at which point a locking mechanism engages. FIG. 4 depicts the components in such a configuration. One nub 140 may encounter the edge of a cam 175 adjoining the shelves 150 to impede rotation beyond the point of maximum relative rotation, while the other nub 140 may encounter another cam 175 that then may rotate against the force of a spring about an axis perpendicular to the board 110.

At this point of relative rotation, a locking mechanism may secure the components in their relative positions, e.g., making the board and binding ready for riding. At some degree of rotation, the nub 140 may no longer contact the cam 175, and the torsion force of the spring may counteract the rotation of the cam 175 and return to its original orientation. In conjunction with the shelves 150, the cams 175 may act to keep the nubs 115 and, subsequently, the entire binding assembly 125 firmly in place. While the shelves 160 prevent vertical retrograde, the cams 175 can prevent horizontal retrograde after the nubs 115 are positioned between them. After the nubs 115 engage and rotate the cams 175, due to the force of the user rotating the binding assembly 125, the torsion springs can force the cams 175 back into their original orientation (like closing a door). If the user attempts to counter-rotate at this point to disengage the locking mechanism, they are prevented from disengaging as the cams 175 hold the nubs 115 in place. These cams 175 can be rotated to allow for the rotation of the binding assembly 125 and removal of the nubs 115 manually by the user by pulling on the leash 185 that is attached to the cam 175, forces of which causes the cam to rotate about an axis point where they no longer obstruct the nubs 115 from movement.

Figure 5:
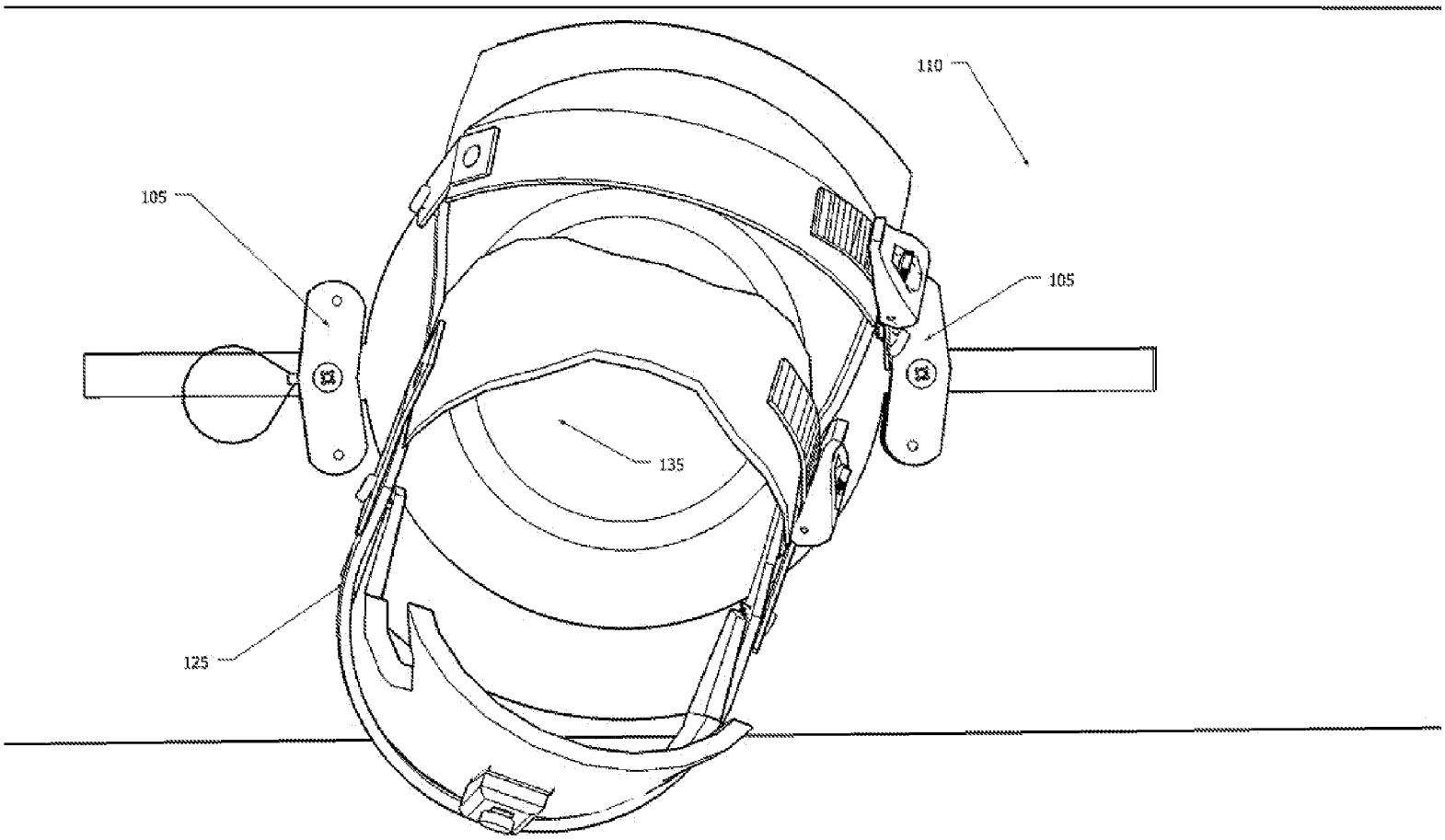
FIG. 5 depicts the binding assembly, viewed from above, mechanically locked with the caps on top of the board deck after the user counters the force of the magnets and rotates the binding assembly in an axis perpendicular to the surface of the board.
Figure 6:
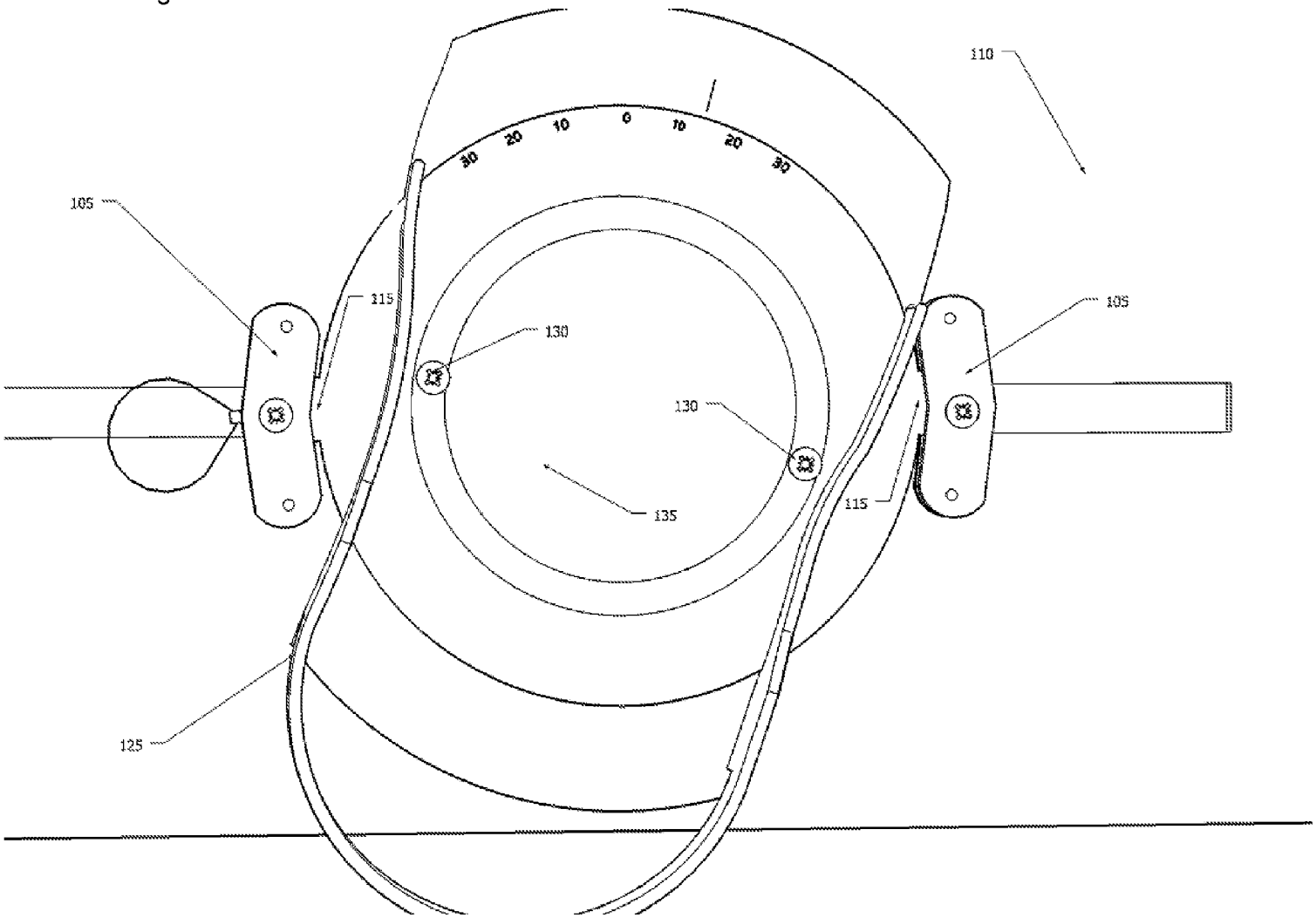
FIG. 6 depicts the angle alignment mechanism in the binding assembling, set at approximately 15 degrees.

FIG. 5 depicts the binding assembly 125 and the caps 105 at maximal relative rotation, in a locked configuration.

or Components may be made of any one or more materials separately or in combination. For example, materials for the caps 105, binding assembly 125, or channel 150 may include, plastic (including but not limited to polycarbonate or other thermoplastics), nylon, glass injected plastic, carbon fiber, graphene, and aluminum and other lightweight, durable metals, among many other materials.

The dimensions of the components may reflect the intended use, including, for example, considerations such as the expected sizes of the board 110 to which the caps 105 may be secured and the boot (and, by extension, the user's foot) that may be secured within the binding assembly 125. In one example, the caps may be roughly 6 inches apart (left to right in relation to the user's foot and boot), approximately 4 inches long (toes to heel in relation to the user's foot and boot), and approximately ½ inch thick. The caps 105 may match the outline dimensions of the binding assembly 125 to create a flush fit when the entire system is locked and operable. These dimensions are for illustrative purposes, as the components may be designed with different dimensions and proportionalities.

A user may dock, engage, and lock the components 105 and 125. The components 105 and 125 may permit a user to easily secure the user's foot to a board for use without use of the hands. For example, a user may be seated on a ski lift when considering snowboarding or standing on a beach when considering kiteboarding, with one foot secured to the board by a binding. The user's other foot may be wearing a boot that is secured within a binding assembly 125, and the binding assembly 125 may correspond to caps 105 that are permanently secured to the board deck 110.

In such circumstances, the user may dock the caps 105 with the binding assembly 125, e.g., by moving a foot so that the bottom of the foot (and thus the bottom of the binding assembly 125) is within a few inches of the top of the board 110, canted approximately 20 degrees counterclockwise or clockwise to the caps 105. So aligned, The magnetic attraction may draw the caps 105 and the binding assembly 125 into a docked configuration.

Having docked the caps 105 and binding assembly 125, the user may then rotate the boot and the enclosing binding assembly 125 20 degrees clockwise or counterclockwise to a point of maximum relative rotation at which the edges of the components 105, 125 may be flush with one another. The cams 175 may then engage the nubs 115, holding the caps 105 and binding assembly 125 in such a relative alignment until released by the user.

The relative placement and sizes of the nubs 115 and shelves 150 may hold the components firmly together. While locked in such a position, the effect of the joined components may be considered equivalent to creating a solid ½ inch base under the user's foot.

What is claimed is:

1. An apparatus for a board binding system comprising:
a board comprising a channel including a first magnet;
a plurality of caps affixed to the board, each of the plurality of caps separated by a distance capable of holding a binding assembly; and
the binding assembly comprising a second magnet, the binding assembly configured to dock with the plurality of caps by arranging the second magnet above the first magnet and rotating the binding assembly.

2. The apparatus of claim 1, wherein each of the plurality of caps comprises a plurality of shelves and a plurality of cams.

3. The apparatus of claim 2, wherein the binding assembly comprises a nub, the nub configured to be engaged to the plurality of cams by rotating the binding assembly.

4. The apparatus of claim 3, wherein the plurality of shelves engages with the nub to prevent the binding assembly from disengaging with the plurality of caps.

5. The apparatus of claim 1, wherein the binding assembly is configured to undock with the plurality of caps by rotating the binding assembly.

6. The apparatus of claim 1, comprising a fastener securing each of the plurality of caps to the board, the fastener passing through a hole in each of the plurality of caps and into an insert on the board.

7. The apparatus of claim 1, wherein the binding assembly comprises an adjusting plate configured to connect to the board between the plurality of caps.

8. The apparatus of claim 1, comprising an unlocking mechanism capable of disengaging the binding assembly from the plurality of caps.

9. The apparatus of claim 1, wherein the board includes at least one of a snowboard, a kiteboard, and a wakeboard.

10. An apparatus for a board binding system comprising:
a board comprising a channel including a first magnet;
an adjusting plate affixed to a binding assembly, the binding assembly including a second magnet; and
a plurality of caps affixed to the board, each of the plurality of caps separated by a distance around the adjusting plate.

11. The apparatus of claim 10, wherein the plurality of caps are affixed to the channel of the board.

12. The apparatus of claim 10, wherein the plurality of caps comprises an unlocking mechanism the unlocking mechanism capable of disengaging the binding assembly from the plurality of caps.

13. The apparatus of claim 12, wherein the unlocking mechanism includes at least one of a leash, a lever, a hook, and an arm.

14. The apparatus of claim 10, wherein the binding assembly comprises a nub and the plurality of caps comprises a cam, the nub configured to secure the binding assembly to the plurality of caps when the nub is rotated to engage with the cam.

15. The apparatus of claim 10, wherein the board includes at least one of a snowboard, a kiteboard, and a wakeboard.

16. An apparatus for a board binding system comprising:
a board including a first magnet;
a plurality of caps affixed to the board, each of the plurality of caps separated by a distance capable of holding a binding assembly;

an adjusting plate affixed to the binding assembly, the adjusting plate capable of securing the binding assembly to the board via engagement with the plurality of caps; and the binding assembly comprising a second magnet, the binding assembly configured to dock with the plurality of caps by arranging the second magnet above the first magnet and rotating the binding assembly and undock with the plurality of caps by rotating the binding assembly.

17. The apparatus of claim 16, wherein the each of the plurality of caps comprises a plurality of shelves, the plurality of shelves configured to lock with the binding assembly when rotated.

18. The apparatus of claim 16, wherein each of the plurality of caps comprises a plurality of cams, the plurality of cams configured to engage with the binding assembly when rotated.

19. The apparatus of claim 16, comprising a first fastener and a second fastener, the first fastener affixing the plurality of caps to the board and the second fastener affixing the adjusting plate to the binding assembly.

20. The apparatus of claim 16, wherein the board includes at least one of a snowboard, a kiteboard, and a wakeboard.

* * * * *